US006424812B1

(12) United States Patent
Hsu

(10) Patent No.: US 6,424,812 B1
(45) Date of Patent: Jul. 23, 2002

(54) TONER CONTAINER AND SCRAPER ARRANGEMENT

(75) Inventor: Hung-Hsu Hsu, Costa Mesa, CA (US)

(73) Assignee: Aetas Technology Corporation, Irvine, CA (US)

( * ) Notice: Subject to any disclaimer, the term of this patent is extended or adjusted under 35 U.S.C. 154(b) by 0 days.

(21) Appl. No.: 09/775,774

(22) Filed: Feb. 1, 2001

(51) Int. Cl.[7] ..... G03G 15/08
(52) U.S. Cl. ..... 399/262; 399/263
(58) Field of Search ..... 399/252, 253, 399/254, 256, 262, 263; 222/DIG. 1

(56) References Cited

U.S. PATENT DOCUMENTS

| | | | | |
|---|---|---|---|---|
| 3,964,648 A | | 6/1976 | Suzuki et al. | 222/333 |
| 4,423,962 A | | 1/1984 | Knott | 366/279 |
| 4,696,418 A | | 9/1987 | Kurotaka et al. | 222/167 |
| 5,089,854 A | * | 2/1992 | Kaieda et al. | 399/262 |
| 5,235,389 A | | 8/1993 | Kikuchi et al. | 399/263 |
| 5,257,077 A | * | 10/1993 | Peter, Jr. et al. | 399/263 |
| 5,424,816 A | | 6/1995 | Fox et al. | 399/263 |
| 5,526,101 A | | 6/1996 | Weed | 399/254 |
| 5,557,382 A | * | 9/1996 | Tatsumi et al. | 399/262 |
| 5,765,079 A | | 6/1998 | Yoshiki et al. | 399/258 |

FOREIGN PATENT DOCUMENTS

| | | | |
|---|---|---|---|
| JP | 408179611 | * | 7/1996 |

* cited by examiner

*Primary Examiner*—Sophia S. Chen
*Assistant Examiner*—Hoan Tran
(74) *Attorney, Agent, or Firm*—BakerBotts, LLP

(57) ABSTRACT

In the embodiments described in the specification a toner container and scraper arrangement includes a toner bottle having a rectangular cross-section and a flexible wire mounted on a rotatable member at the outlet opening for the toner bottle. The flexible wire, which may be made of resilient metal or plastic material, extends at an angle to the axis of rotation so that it engages all of the interior surface regions of the toner bottle to release adhering toner as the rotatable member is rotated.

6 Claims, 3 Drawing Sheets

TONER CONTAINER AND SCRAPER ARRANGEMENT

BACKGROUND OF THE INVENTION

This invention relates to containers provided with a wire scraper arrangement for supplying toner to electrophotographic machines or the like.

Many containers such as plastic bottles for electrophotographic toner are arranged to supply toner by gravity to electrophotographic machines and require a scraper or agitator to release toner adhering to the inner surface of the container. This is especially important in containers with inner surfaces which have corners or other locations in which toner becomes compacted and will not fall by gravity out of the container into a machine in which the container is mounted. To overcome this problem some containers have a plastic film strip or a complex wire structure arranged to scrape the inner wall of the container. These are effective when the container has a circular configuration but such structures encounter high variations in resistance when scraping walls which have a non circular configuration, resulting in large variations in torque required to drive the scraper.

U.S. Pat. Nos. 3,964,648, 4,423,962, 4,696,418, 5,235,389, 5,424,816 and 5,526,101 disclose various configurations of wire scrapers or agitators in toner containers having a circular internal cross-section. These wire scrapers or agitators have a complex structure and none of them is designed for use with a toner container having a non-circular cross-sectional configuration.

SUMMARY OF THE INVENTION

Accordingly, it is an object of the present invention to provide a toner container and wire scraper arrangement which overcomes disadvantages of the prior art.

Another object of the invention is to provide a toner container arrangement having a wire scraper arranged to scrape substantially all interior surface areas of the container in a simple and effective manner.

A further object of the invention is to provide a toner container and scraper arrangement which is capable of scraping the inner surface of a container having a non-circular section without producing substantial variations in the load applied to a drive system for the scraper.

These and other objects of the invention are attained by providing a toner container having an interior surface and an outlet opening with a central axis extending through the outlet opening and a rotatable support member adjacent to the outlet opening of the container along with a flexible wire supported on the support member and projecting in a direction away from the central axis toward the interior surface so as to scrape the interior surface when the support member is rotated. In one embodiment the toner container has a non-circular cross-sectional configuration including a plurality of interior wall surfaces with angular intersections and has a generally circular outlet opening and a rotatable support member connectable to a drive gear is supported in the outlet opening and carries a flexible wire attached at the end of an arm extending radially from the rotatable support member and projecting in a direction substantially perpendicular to the arm on which it is attached.

BRIEF DESCRIPTION OF THE DRAWINGS

Further objects and advantages of the invention will be apparent from the reading of the following description in conjunction with the accompanying drawings, in which.

DESCRIPTION OF PREFERRED EMBODIMENTS

Figure 1:
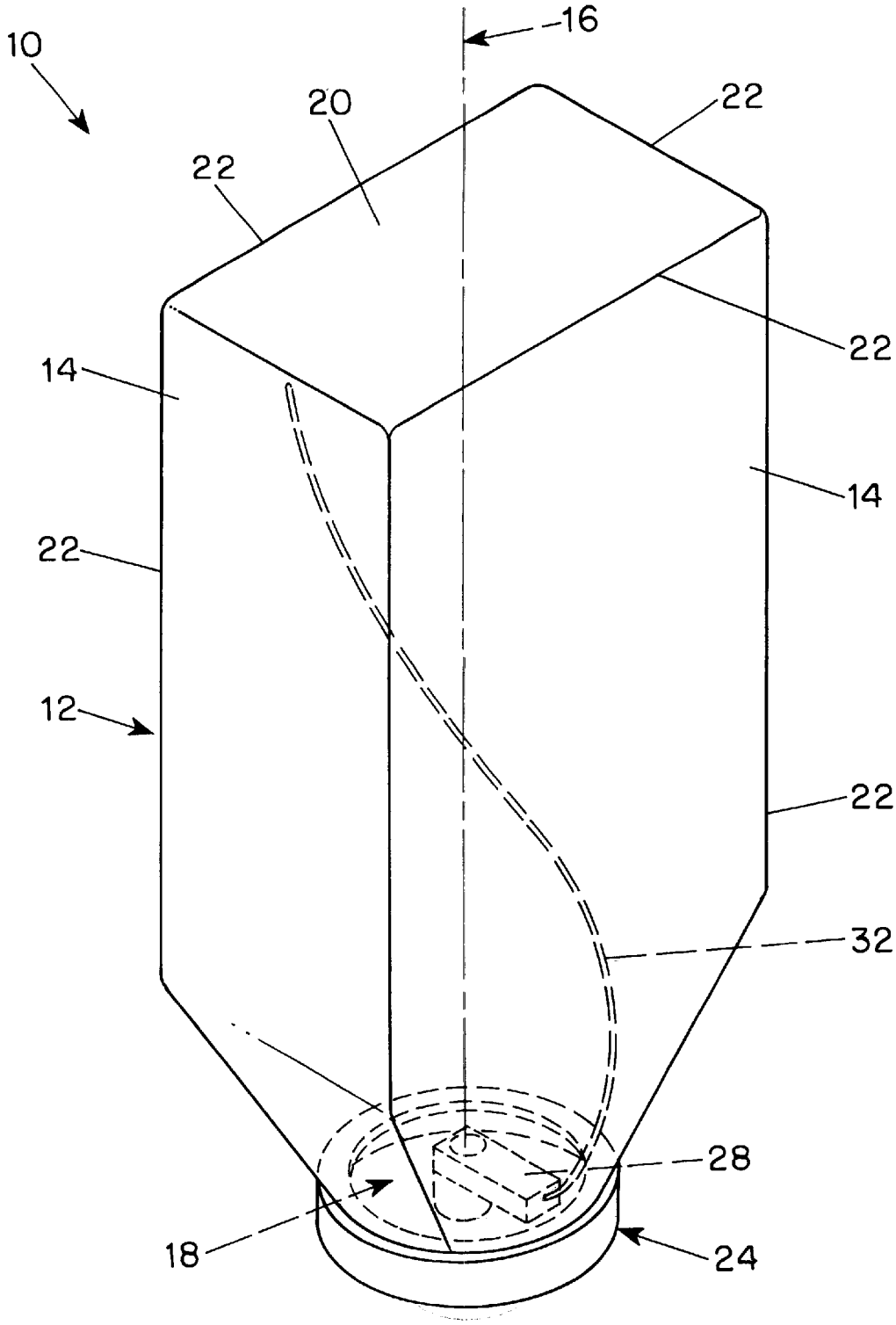
FIG. 1 is a perspective view illustrating a representative embodiment of a toner container and wire scraper arrangement in accordance with the invention.
Figure 2:
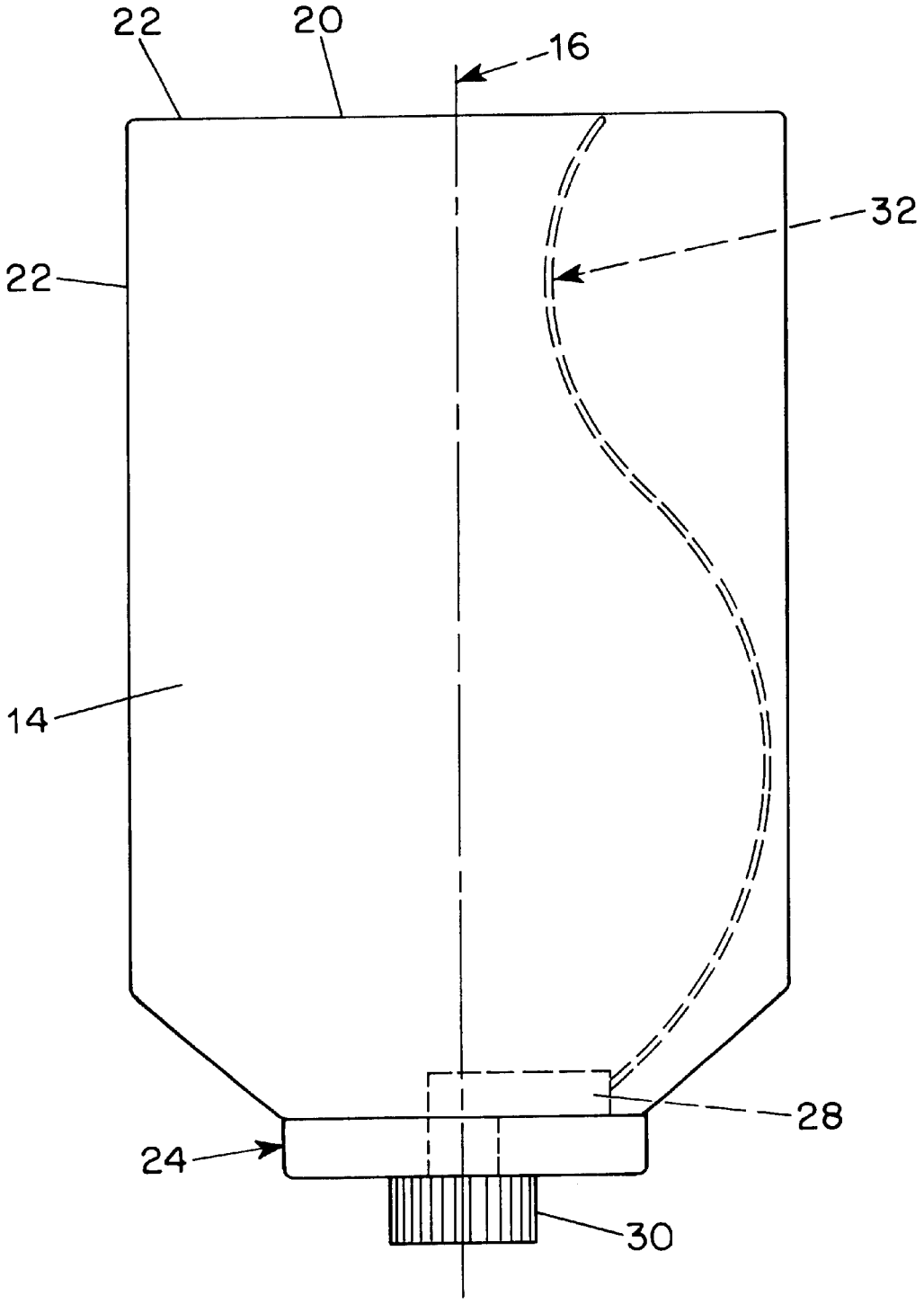
FIG. 2 is a side view of the arrangement shown in FIG. 1.

In the typical embodiment of the invention illustrated in FIGS. 1 and 2, a toner container arrangement 10 includes a bottle 12 having a non-circular cross-sectional configuration such as a rectangle with a plurality of side walls 14 extending parallel to an axis 16 passing through an outlet opening 18 at one end of the toner bottle and an end wall at the opposite end of the bottle. As shown in FIGS. 1 and 2, the walls 14 and 20 of the bottle in this embodiment have angular intersections 22 in which toner may adhere and become compacted.

Figure 3:
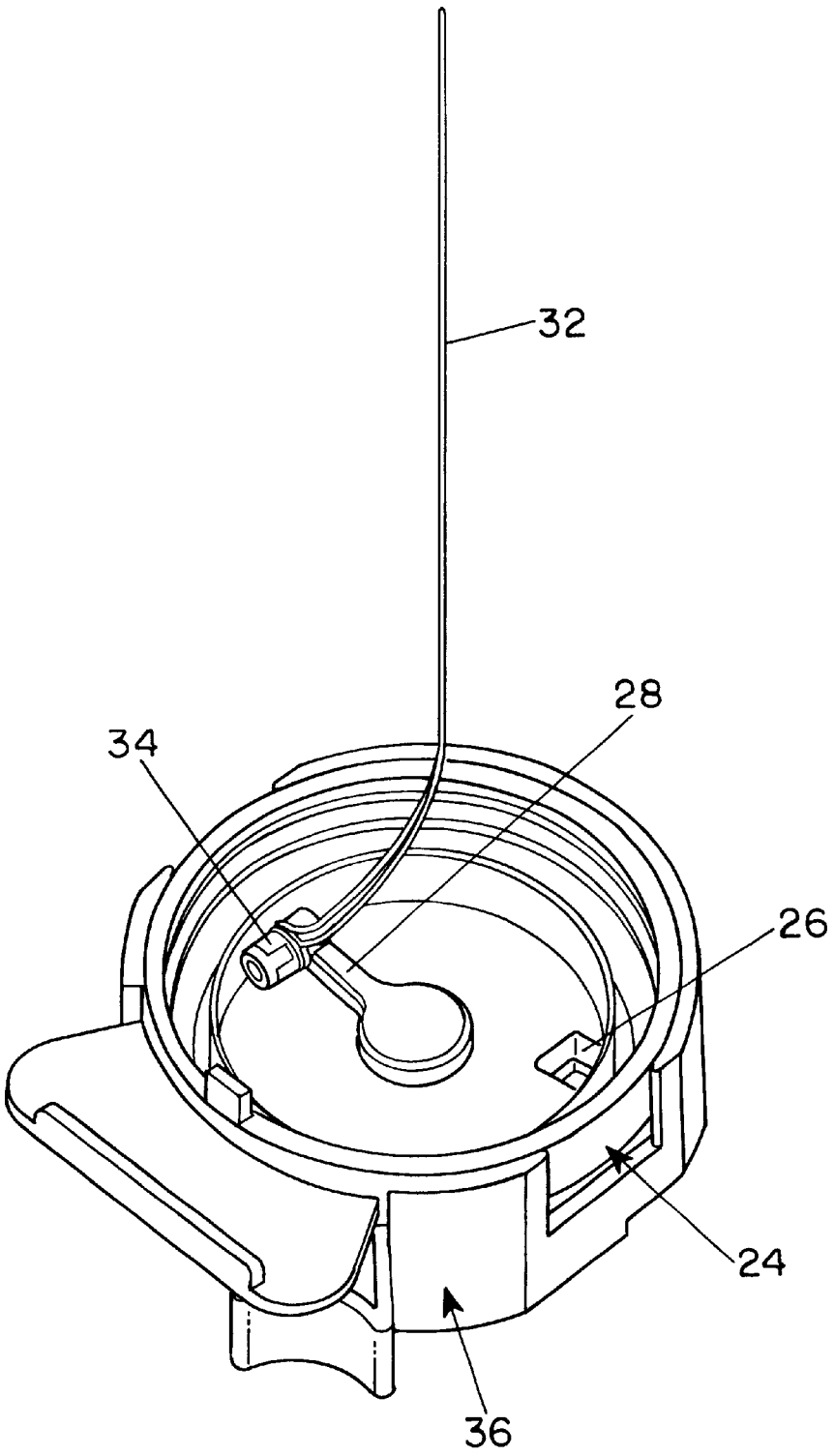
FIG. 3 is a perspective view showing a cap for the toner container with a rotatable support member and a wire scraper attached to the support member.

A cap 24 is mounted on the outlet end 18 of the bottle and, as best seen in FIG. 3, the cap includes an opening 26 providing an outlet for toner when the bottle is mounted in its inverted position shown in FIGS. 1 and 2 to permit toner to flow by gravity into a machine (not shown) in which the bottle is mounted. In many instances, however, toner will adhere to the inner surface of the bottle, particularly if the inner surface of the bottle is irregular and has angular intersections 20 between adjacent walls 14 so that the toner will not fall readily by gravity toward the outlet opening 26.

In order to overcome this problem and also to provide and a simple and inexpensive scraper for a toner bottle, the cap 24 is provided is with a rotatable support member such as an arm 28 shown in FIG. 3, which is driven, for example, by a gear 30, illustrated in FIG. 2, which may, in turn, be driven by another gear, not shown, in a machine in which the bottle is mounted. At the radially outer end of the arm 28 a flexible wire 32 is mounted in a socket 34 and positioned so that the flexible wire extends away from the socket in a direction transverse to the bottle axis 16 so that it engages the inner surfaces of the bottle at all locations, including the intersections 22, as the arm 28 is rotated, thereby engaging and releasing any toner adhering to the walls of the bottle.

The flexible wire 32, which is preferably long enough to engage and scrape the end wall 20 as well as the side walls 14, is made of any flexible material which is strong enough to bear against and wipe the walls of the bottle as the arm 28 is rotated without requiring excessive torque to rotate the arm. Typical materials used for the wire 32 are resilient metals such as spring steel and resilient plastic material such as high density polyethylene.

As best seen in FIG. 3, which does not illustrate the bottle 12, the cap 24 is removably received in a receptacle 36 of a machine to which the toner in the bottle 10 is to be supplied. During operation of the machine the gear 30 is driven to rotate the arm 28 carrying the flexible wire 32 to sweep the wire along the walls 14 of the toner bottle as well as into the angular intersections 20 to loosen and remove any adhering toner, permitting it to fall toward the outlet opening 26 at the open end 18 of the bottle. Moreover, because the wire 32 is flexible the torque required to scrape it along the walls of a rectangular or irregular shaped bottle is low and does not vary significantly as the wire moves into and out of the intersections 22 and along the walls 14.

With this arrangement a simple inexpensive toner scraper arrangement for releasing toner adhering to the walls of the toner container is provided, thereby eliminating the need for more complex scraping arrangements disclosed in the prior art.

Although the invention has been described herein with reference to a specific embodiment, many modifications and variations therein will readily occur to those skilled in the art. For example, although a toner bottle with a rectangular cross-section has been described and illustrated, the flexible wire scraper arrangement of the invention is equally useful in toner bottles having a circular cross-section and is less complex and expensive than conventional scraper arrangements used in such containers. Moreover, the flexible wire may be mounted directly on an axial shaft extending into the toner bottle rather than being affixed to an end of a radial arm in the manner shown in the drawings. Accordingly, all such variations and modifications are included within the intended scope of the invention.

I claim:

1. A toner container and scraper arrangement comprising:

a toner container having an inside wall and an outlet opening at one end of the container;

a rotatably driven member extending into the outlet opening;

the toner container having a non-circular cross-sectional shape in a direction perpendicular to the axis of rotation of the driven member; and a flexible wire mounted on the rotatably driven member and projecting at an angle transverse to the axis of rotation of the driven member so as to engage and move along all portions of the inside wall of the toner container as the driven member is rotated.

2. A toner container and scraper arrangement according to claim 1 wherein the toner container has a rectangular cross-sectional shape.

3. A toner container and scraper arrangement according to claim 1 wherein the flexible wire is made of resilient metal.

4. A toner container and scraper arrangement according to claim 1 wherein the flexible wire is made of a resilient plastic material.

5. A toner container and scraper arrangement according to claim 1 wherein the driven member includes an arm extending radially from the axis of rotation of the driven member and the flexible wire is mounted at a radially outer portion of the arm.

6. A toner container and scraper arrangement according to claim 1 including a gear mounted on the driven member and arranged for engagement with another gear in a machine in which the toner container is to be mounted.

* * * * *